US010858916B2

(12) United States Patent
Fripp

(10) Patent No.: US 10,858,916 B2
(45) Date of Patent: Dec. 8, 2020

(54) BIFLEX WITH FLOW LINES

(71) Applicant: Halliburton Energy Services, Inc., Houston, TX (US)

(72) Inventor: Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/323,109

(22) PCT Filed: Apr. 18, 2018

(86) PCT No.: PCT/US2018/028073
§ 371 (c)(1),
(2) Date: Feb. 4, 2019

(87) PCT Pub. No.: WO2018/204066
PCT Pub. Date: Nov. 8, 2018

(65) Prior Publication Data

US 2020/0048995 A1 Feb. 13, 2020

Related U.S. Application Data

(60) Provisional application No. 62/492,831, filed on May 1, 2017.

(51) Int. Cl.
*E21B 43/10* (2006.01)

(52) U.S. Cl.
CPC ..... *E21B 43/108* (2013.01)

(58) Field of Classification Search
CPC ..... E21B 43/108
See application file for complete search history.

(56) References Cited

U.S. PATENT DOCUMENTS 6,513,588 B1 * 2/2003 Metcalfe ..... E21B 43/08 166/242.2
7,185,709 B2 3/2007 Schetky et al.
8,230,913 B2 7/2012 Hart et al.
9,016,365 B2 * 4/2015 Kang ..... E21B 43/08 166/227

(Continued)

FOREIGN PATENT DOCUMENTS

WO 2018204066 A1 11/2018

OTHER PUBLICATIONS

Hackworth, M., et al., "Development and First Application of Bistable Expandable Sand Screen," SPE 84265, Society of Petroleum Engineers Inc., SPE Annual Technical Conference and Exhibition, Denver, Colorado, Oct. 5-8, 2003, 13 pages.

*Primary Examiner* — Robert E Fuller
(74) *Attorney, Agent, or Firm* — Scott Richardson; Parker Justiss, P.C.

(57) ABSTRACT

Provided is a well screen assembly, and method of use therefore. The well screen assembly, in one embodiment, includes a plurality of fluid collecting elements, wherein the fluid collecting elements have collection troughs extending along a length thereof. The well screen assembly, of this embodiment, further includes filter elements positioned over the collection troughs, and flexure mechanisms connecting proximate pairs of the fluid collecting elements, the flexure mechanisms allowing the plurality of fluid collecting elements to radially extend from a compact state to a radially extended state.

20 Claims, 12 Drawing Sheets

(56) References Cited

U.S. PATENT DOCUMENTS

| | | | | |
|---|---|---|---|---|
| 9,097,105 | B2 | 8/2015 | Holderman et al. | |
| 9,353,606 | B2 | 5/2016 | Bruce et al. | |
| 9,945,212 | B2 * | 4/2018 | Sanders | E21B 43/108 |
| 10,337,297 | B2 * | 7/2019 | Bruce | E21B 43/108 |
| 2008/0283240 | A1 | 11/2008 | Baaijens et al. | |
| 2010/0051262 | A1 | 3/2010 | Dusterhoft et al. | |
| 2010/0051270 | A1 | 3/2010 | Dusterhoft et al. | |
| 2010/0051271 | A1 | 3/2010 | Gano et al. | |
| 2011/0042096 | A1 | 2/2011 | Nutley et al. | |
| 2014/0083720 | A1 | 3/2014 | Kang et al. | |
| 2015/0000897 | A1 * | 1/2015 | Lopez | E21B 43/088<br>166/230 |
| 2016/0024897 | A1 | 1/2016 | Greci et al. | |

* cited by examiner

BIFLEX WITH FLOW LINES

CROSS-REFERENCE TO RELATED APPLICATION

This application is the National Stage of, and therefore claims the benefit of, International Application No. PCT/US2018/028073 filed on Apr. 18, 2018, entitled "BIFLEX WITH FLOW LINES," which was published in English under International Publication Number WO 2018/204066 on Nov. 8, 2018, and has a priority date of May 1, 2017, based on application 62/492,831. Both of the above applications are commonly assigned with this National Stage application and are incorporated herein by reference in their entirety.

BACKGROUND

In a well system, well screen assemblies are used to filter against the passage of particulate from the wellbore into the production string. The wellbore around the screens is often packed with gravel to assist in stabilizing the formation and to pre-filter against particulate before the particulate reaches the screens. A uniform gravel packing can, however, be difficult to achieve due to formation of sand bridges and other complications experienced when pumping the gravel slurry into the region around the screens. Therefore, sometimes expandable screens that expand into contact with the wellbore are used in place of gravel packing. What is needed in the art is an improved expandable screen that does not experience the drawbacks of existing screens.

BRIEF DESCRIPTION

Reference is now made to the following descriptions taken in conjunction with the accompanying drawings, in which.

DETAILED DESCRIPTION

Figure 1A:
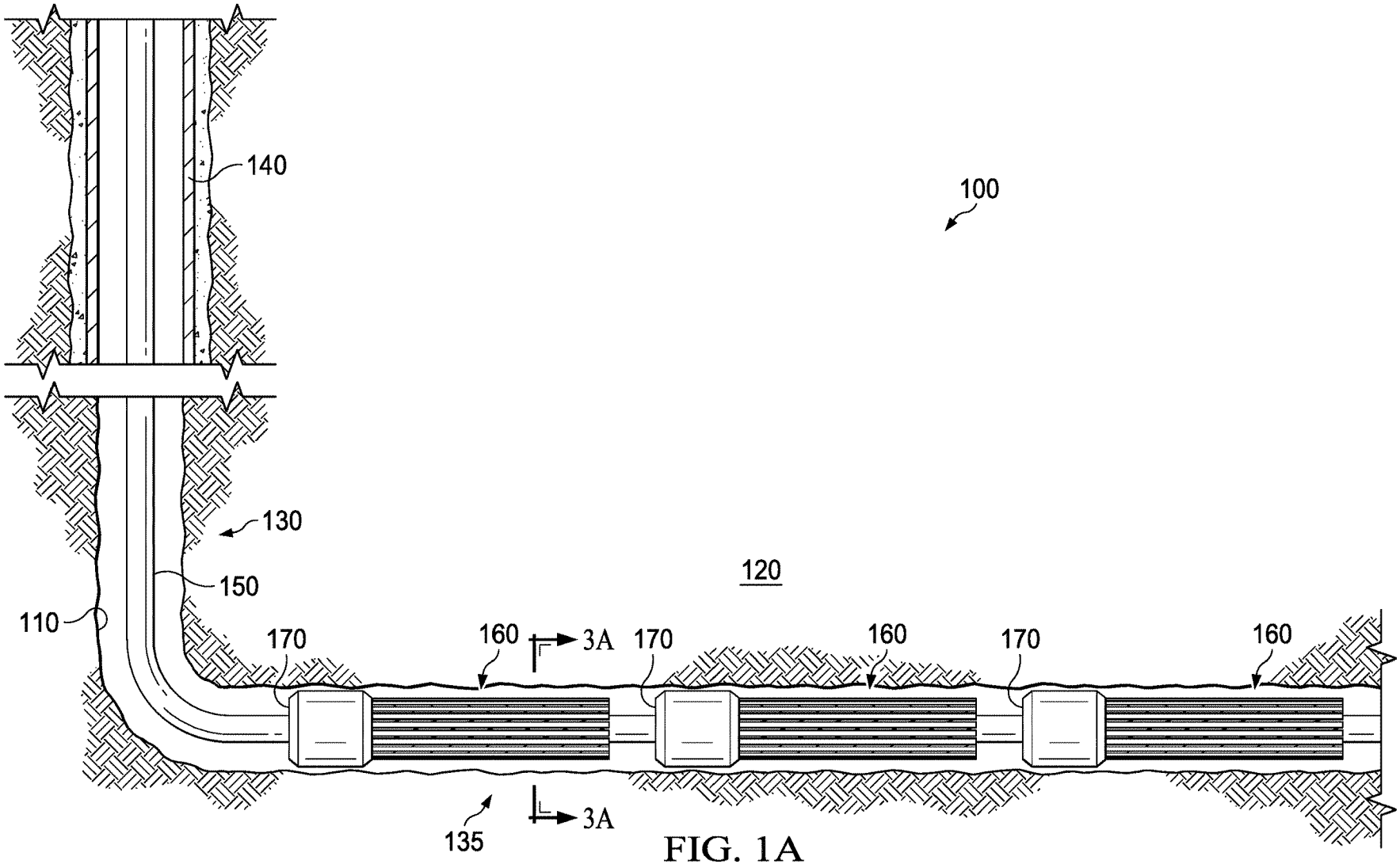
FIGS. 1A-1B illustrate an example well system with screen assemblies according to certain embodiments of the present disclosure.

Referring to FIG. 1A, illustrated is an example well system 100 with screen assemblies 160 according to certain embodiments of the present disclosure. The well system 100 includes a bore (e.g., wellbore 110) extending through various earth strata, including the subterranean formation 120. The wellbore 110 has a substantially vertical section 130 and a substantially horizontal section 135. The substantially vertical section 130 includes a casing string 140 cemented at an upper portion thereof. The substantially horizontal section 135, in this embodiment, is open hole and extends through the hydrocarbon bearing subterranean formation 120.

A tubing string 150 extends from the surface within the wellbore 110. The tubing string 150 can provide a conduit for formation fluids to travel from the substantially horizontal section 135 to the surface. Screen assemblies 160, in this embodiment, are positioned with the tubing string 150 in the substantially horizontal section 135. The screen assemblies 160 are shown in a compact (e.g., running or unextended) configuration in FIG. 1A, and are coupled to one or more collection mandrels 170. In some embodiments, screen assemblies 160 are sand control screen assemblies that can receive hydrocarbon fluids from the formation, direct the hydrocarbon fluids for filtration or otherwise, and stabilize the subterranean formation 120.

Figure 1B:
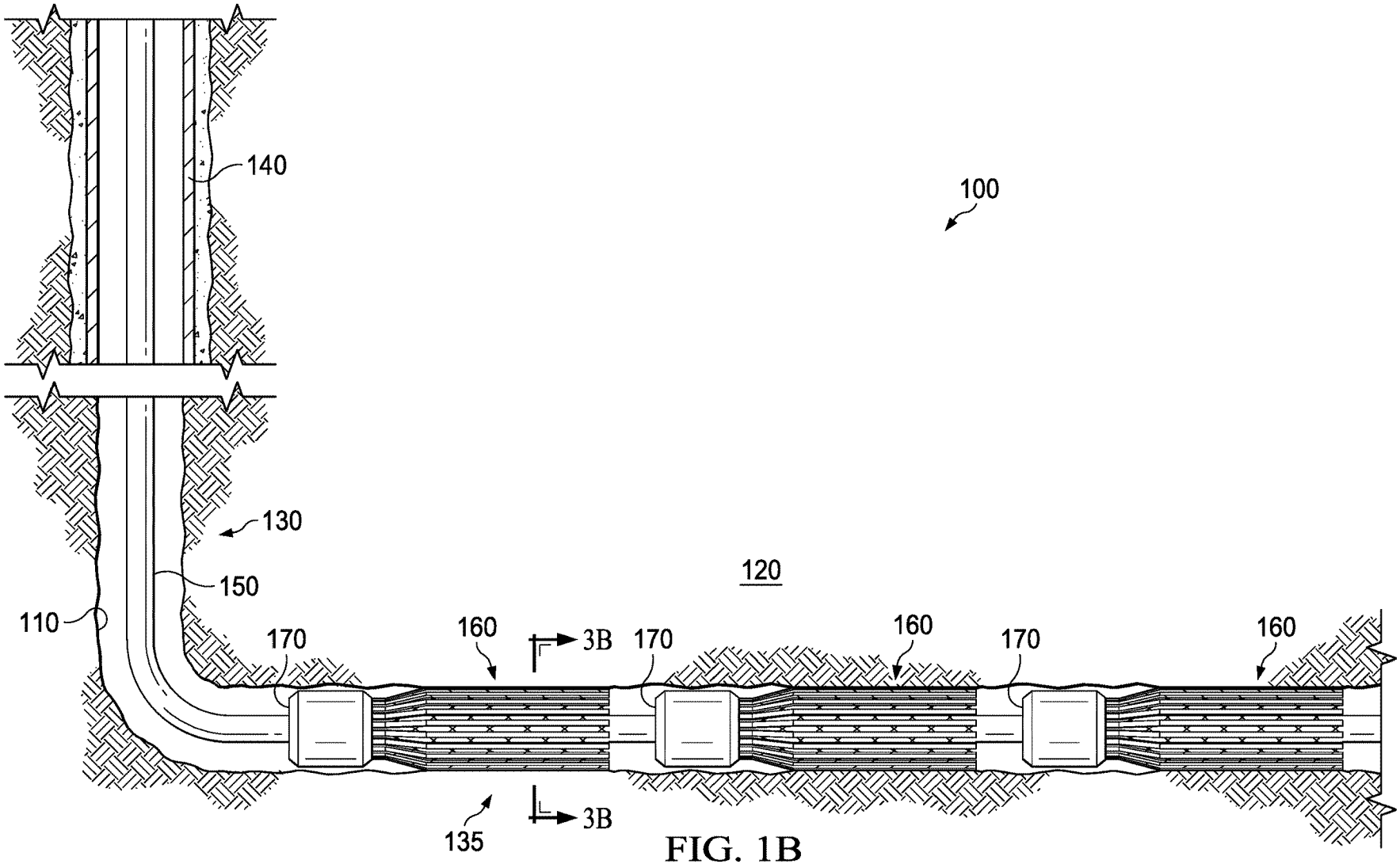

FIG. 1B shows the well system 110 with the screen assemblies 160 in an operating or a radially extended configuration. In certain embodiments, each of the screen assemblies 160 can include a plurality of fluid collecting elements, wherein the fluid collecting elements have collection troughs extending along a length thereof. The screen assemblies 160, in these embodiments, may further include filter elements positioned over the collection troughs, and flexure mechanisms connecting proximate pairs of the fluid collecting elements. The flexure mechanisms, in these embodiments, allow the plurality of fluid collecting elements to radially extend from a compact state (e.g., as shown in FIG. 1A) to a radially extended state (e.g., as shown in FIG. 1B). The screen assemblies 160, in certain other embodiments, may include a plurality of sealing elements positioned radially outside of the flexure mechanisms and connecting adjacent edges of the plurality of fluid collecting elements. Screen assemblies 160 in such embodiments may also include one or more expansion structures positioned proximate an inner surface of the fluid collecting elements. The expansion structures, which in one embodiment are swellable elastomer structures, may be positioned between the inner surface of the fluid collecting elements and a tubular base pipe. When the activating fluid contacts the expansion structures, the swellable material of each of the expansion structures can expand. Expansion of the swellable material can radially extend the plurality of fluid collecting elements from the compact state to the radially extended state to contact a surface of wellbore 110. The activating fluid may be any fluid to which the swellable material responds by expanding. Examples of activating fluid include hydrocarbon fluids, water, and gasses.

FIGS. 1A and 1B show tubing string 150 with three screen assemblies 160. More or less than three screen assemblies 160 may be used in a conventional well system 100. Tubing strings 150 according to various embodiments of the present disclosure may include any number of other tools and systems in addition to the three screen assemblies 160. Examples of other tools and systems include fluid flow control devices, communication systems, and safety systems, among others. Tubing string 150 may also be divided into intervals using zonal isolation devices such as packers (not shown). Zonal isolation devices may be made from materials that can expand upon contact with a fluid, such as hydrocarbon fluids, water, and gasses.

FIGS. 1A and 1B illustrate the screen assemblies 160 in the substantially horizontal section 135 of the wellbore 110. Screen assemblies 160 according to various embodiments of the present disclosure, however, can be used in other locations of wellbores, such as deviated, vertical, or multilateral wellbores. Deviated wellbores may include directions different than, or in addition to, a general horizontal or a general vertical direction. Multilateral wellbores can include a main wellbore and one or more branch wellbores. Directional descriptions are used herein to describe the illustrative embodiments but, like the illustrative embodiments, should not be used to limit the present disclosure.

Screen assemblies 160 according to some embodiments of the present disclosure can be disposed in an injection well.

In an injection well, water or other fluid is injected into the well to increase flow of hydrocarbon fluids to a nearby production well. One or more screen assemblies 160 can be disposed in the injection well to provide support during and after the fluid injection process. In addition, screen assemblies 160 according to some embodiments of the present disclosure can be disposed in a cased hole completion.

Figure 2A:
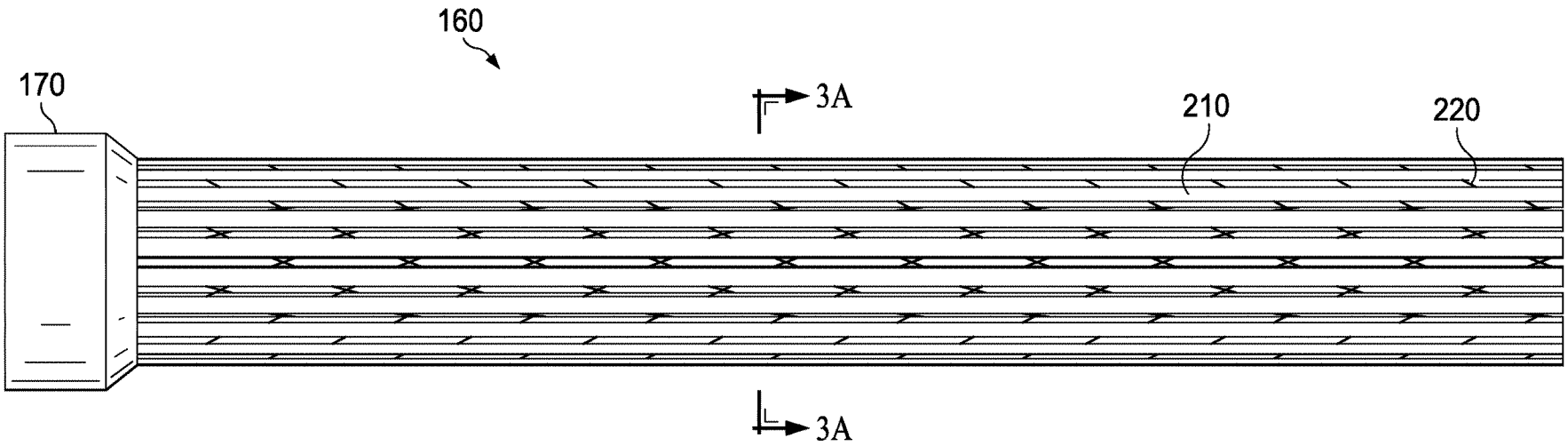
FIGS. 2A and 2B illustrate enlarged views of the screen assemblies and collection mandrels illustrated in FIGS. 1A and 1B, respectively.
Figure 2B:
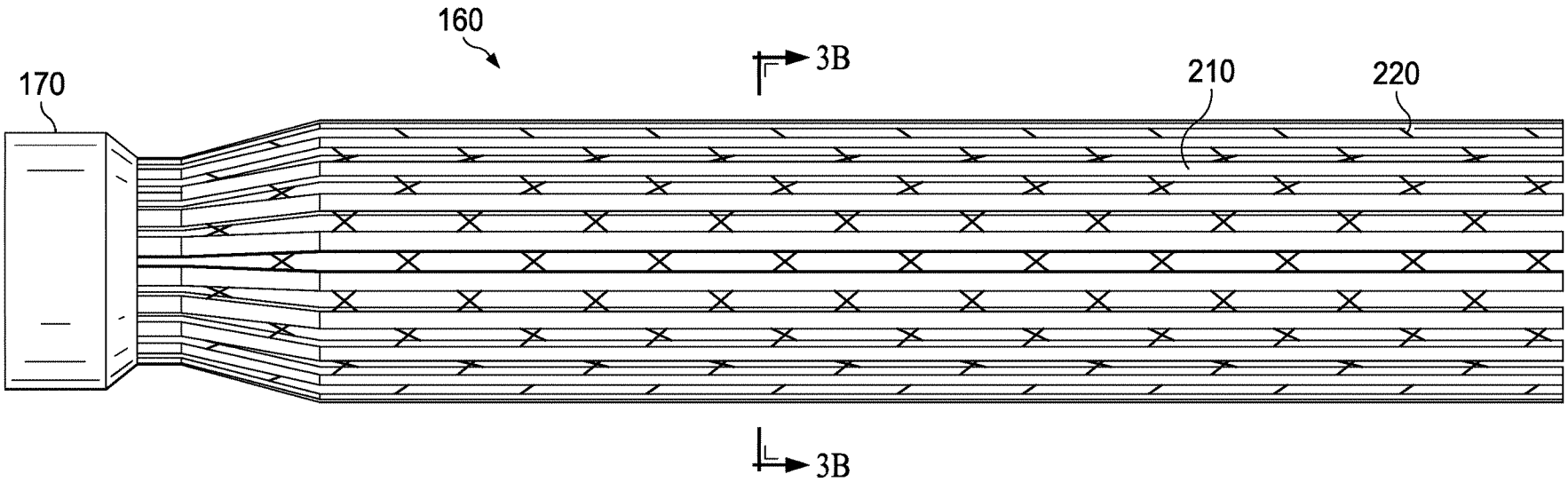

Referring to FIGS. 2A and 2B, illustrated are enlarged views of the screen assemblies 160 and collection mandrels 170 illustrated in FIGS. 1A and 1B, respectively. Accordingly, FIG. 2A illustrates the screen assembly 160 in the compact state, whereas FIG. 2B illustrates the screen assembly 160 in the radially extended state. The screen assemblies 160 of FIGS. 2A and 2B include a plurality of fluid collecting elements 210. In the illustrated embodiment, the plurality of fluid collecting elements 210 extend along a length of the wellbore 110 (FIGS. 1A and 1B). The plurality of fluid collecting elements 210 are configured, when in the radially extended state, to collect fluid from the subterranean formation 120 (FIGS. 1A and 1B). The plurality of fluid collecting elements 210 are then configured to provide the fluid to the collection mandrel 170 (e.g., via a port in the collection mandrel 170), which may then travel to the surface via the tubing string 150 (FIGS. 1A and 1B).

In the embodiment of FIGS. 2A and 2B, flexure mechanisms 220 connect proximate pairs of the fluid collecting elements 210. In the illustrate embodiment, the flexure mechanisms 220 interpose the proximate pairs of the fluid collecting elements 210. Other embodiments may exist wherein the flexure mechanisms do not interpose the fluid collection elements, but for example are located along the top or bottom surfaces thereof. The flexure mechanisms 220 allow the plurality of fluid collecting elements 210 to radially extend from the compact state (e.g., as shown in FIG. 2A) to the radially extended state (e.g., as shown in FIG. 2B).

In certain embodiments, such as shown in the radially extended state of FIG. 2B, the flexure mechanisms 220 taper in size and angle proximate one end of the plurality of collecting elements 210. Accordingly, the flexure mechanisms 220 cause the plurality of collecting elements 210 to taper toward one another proximate that end when in the radially extended state. In this embodiment, the tapered flexure mechanisms 220 allow the screen assembly 160 to fully expand along its entire length but have the amount of expansion to be variable. In the illustrated embodiment, the plurality of fluid collecting elements 210 are thus capable of being fully expanded while still being able to taper toward the collection mandrel 170. Additional details regarding the foregoing flexure mechanisms may be found in U.S. Pat. Nos. 7,185,709 and 8,230,913, which are incorporated herein by reference.

Figure 3A:
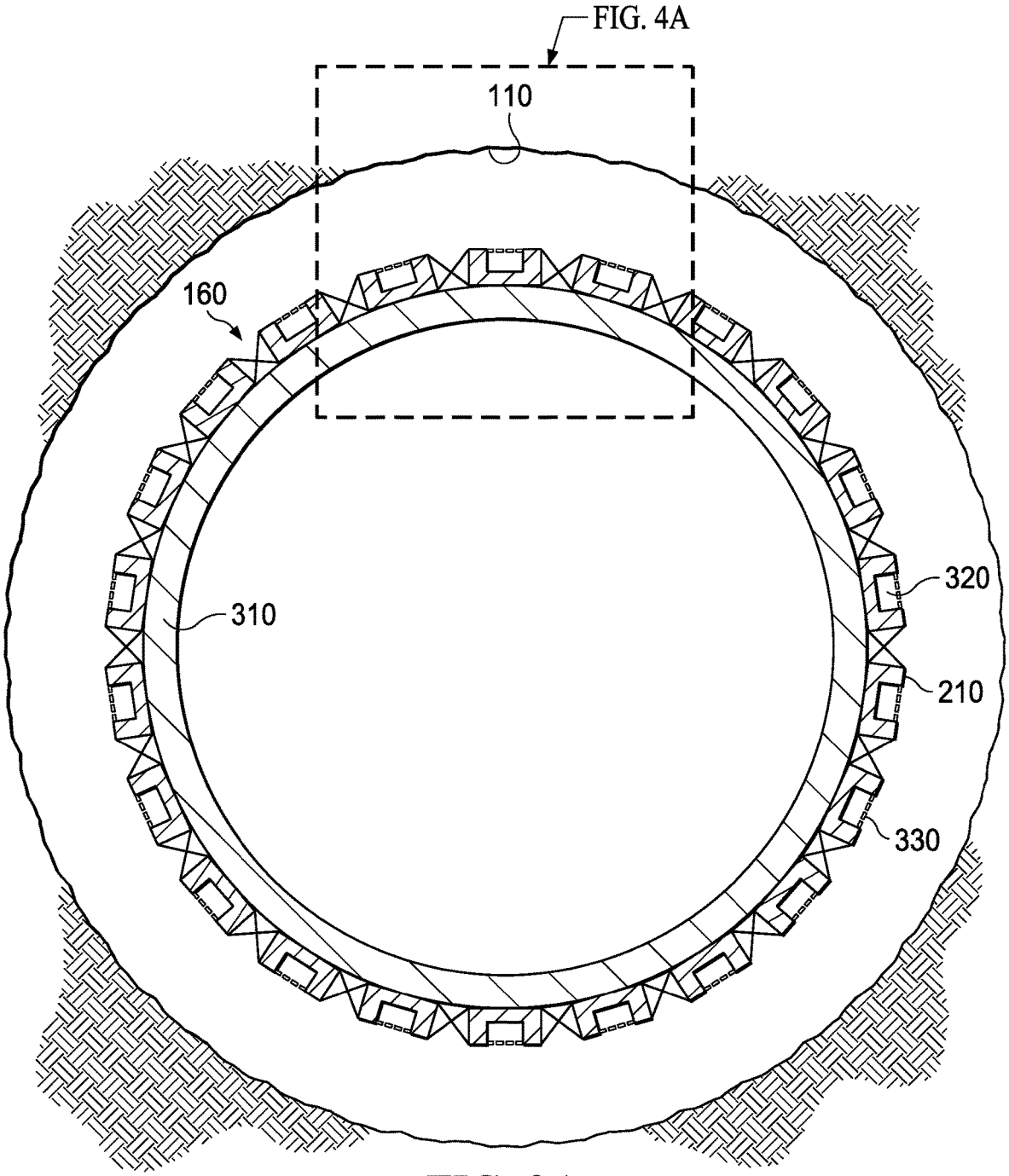
FIGS. 3A-4B illustrate cross-sectional and enlarged views of the screen assemblies of FIGS. 1A-2B.
Figure 3B:
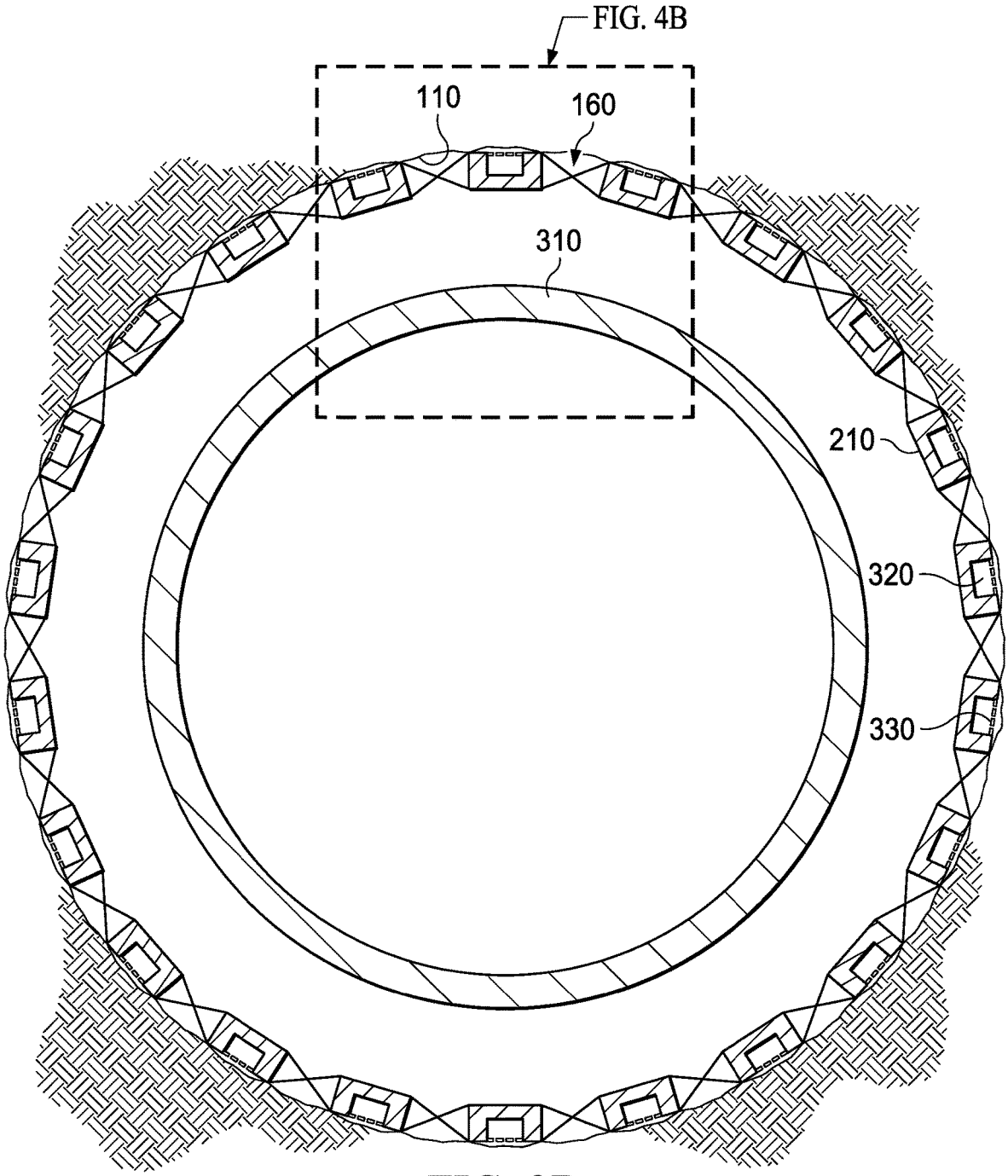
Figure 4A:
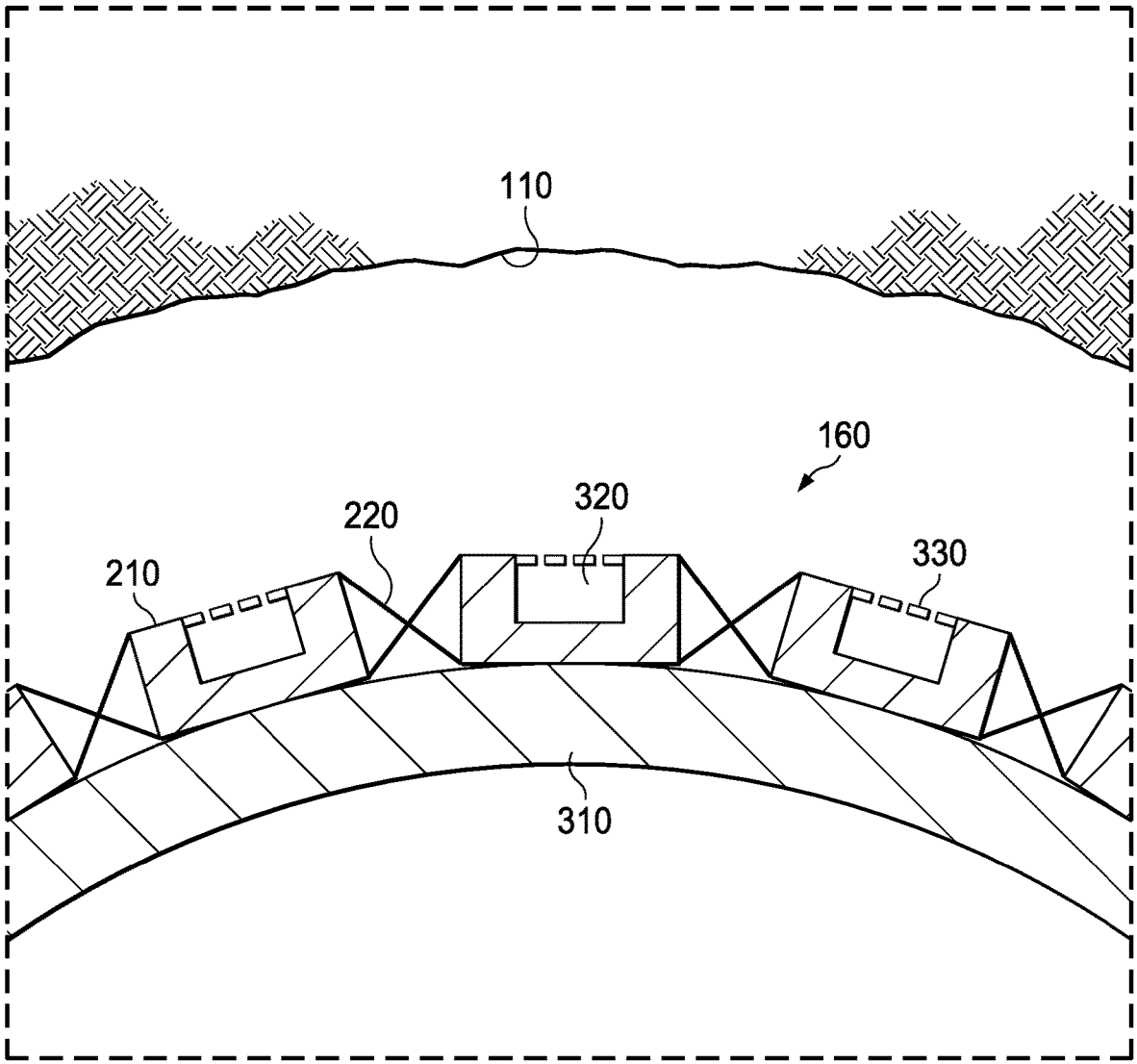
Figure 4B:
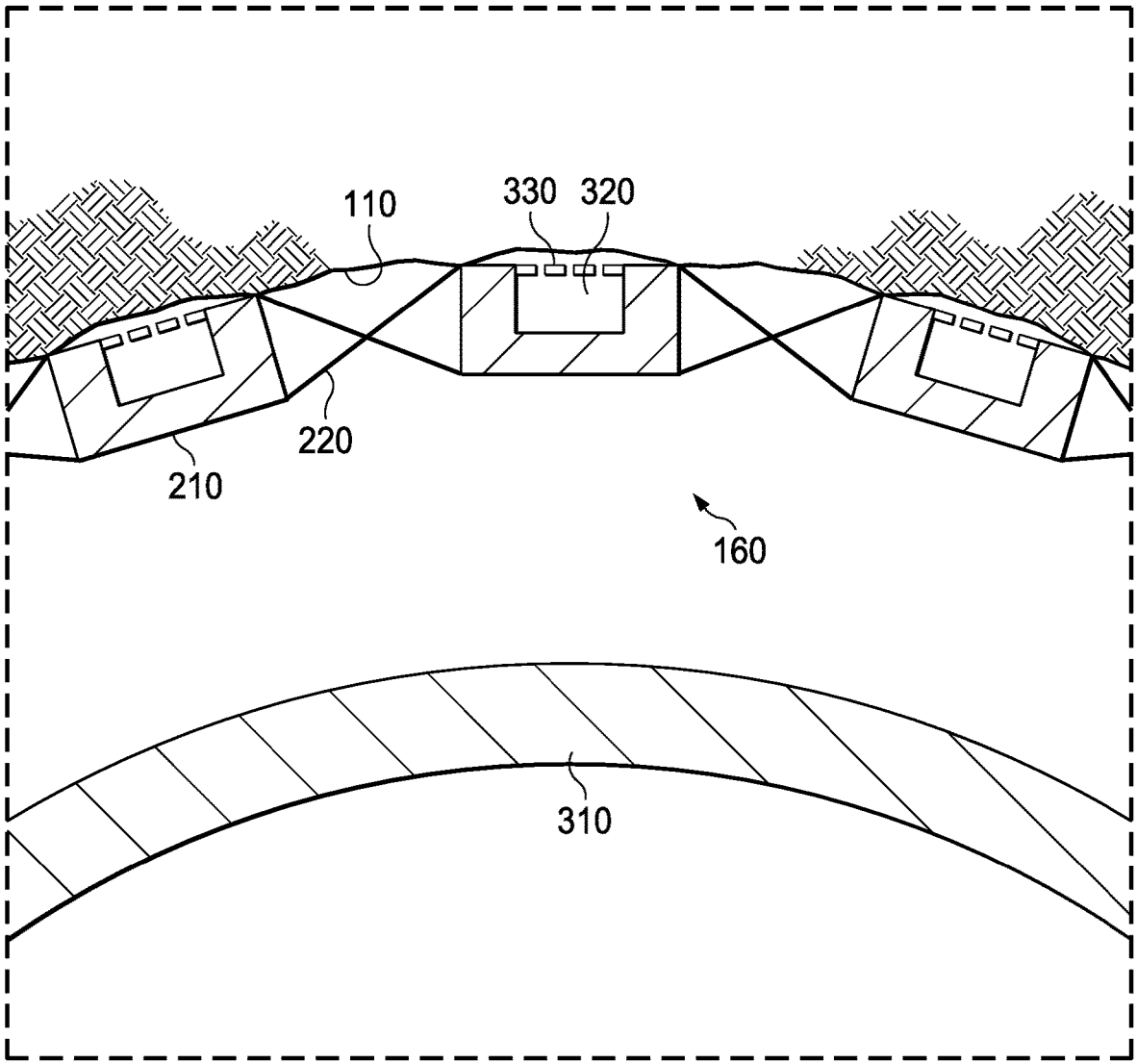

Turning to FIGS. 3A-4B, illustrated are cross-sectional and enlarged views of the screen assemblies 160 of FIGS. 1A-2B. FIG. 3A illustrates a cross-sectional view of the screen assembly 160 of FIG. 1A in the compact state, whereas FIG. 4A illustrates an enlarged view of a portion of the screen assembly 160 of FIG. 3A. Similarly, FIG. 3B illustrates a cross-sectional view of the screen assembly 160 of FIG. 1B in the radially extended state, whereas FIG. 4B illustrates an enlarged view of a portion of the screen assembly 160 of FIG. 3B.

The screen assemblies 160 illustrated in FIGS. 3A-4B, in accordance with the disclosure, include the plurality of fluid collecting elements 210 and the flexure mechanisms 220 connecting proximate pairs of the fluid collecting elements 210. The screen assemblies 160 of FIGS. 3A-4B include twenty-two fluid collecting elements 210 and associated flexure mechanisms 220. Notwithstanding, screen assemblies 160 according to various embodiments of the present disclosure can include any number, from a handful to many, of fluid collecting elements 210 and associated flexure mechanisms 220 and remain within the scope of the disclosure.

The fluid collecting elements 210 and flexure mechanisms 220, in certain embodiments, are formed around a tubular base pipe 310 and positioned within the wellbore 110. The fluid collecting elements 210 and flexure mechanisms, in the embodiment shown, collectively form a biflex structure. The biflex structures, in certain embodiments, are bi-stable, and thus are stable in the compact states illustrated in FIGS. 3A and 4A, as well are stable in the radially extended states illustrated in FIGS. 3B and 4B. The term bi-stable, as used herein, means that the expansion force changes with the amount of expansion. In one case, the expansion force needed to expand a bi-stable device decreases once a certain expansion distance is reached. In another case, the rate of increase of the expansion force needed to expand a bi-stable device decreases once a certain expansion distance is reached.

In accordance with the disclosure, one or more of the fluid collecting elements 210 have troughs 320 extending along a length thereof, and in certain other embodiments along an entire length thereof. In many embodiments, each of the fluid collecting elements 210 has a trough 320, but in other embodiments less than all of the fluid collecting elements 210 has a trough 320. The troughs 320 may comprise a variety of different sizes and shapes. In the illustrated embodiment of FIGS. 3A-4B, the troughs 320 are U-shaped and have a flat interior bottom surface. In an alternative embodiment, the troughs 320 are U-shaped, but have a curved interior bottom surface, and in yet other embodiments, the troughs 320 have a V-shaped or other-shaped interior surface.

Positioned over the collection troughs 320 in the embodiment of FIGS. 3A-4B are one or more filter elements 330. In one embodiment, individual filter elements 330 are positioned over ones of the collection troughs 320. Accordingly, in this embodiment there are an equal number of filter elements 330 and troughs 320. Other embodiments, however, exist wherein a different ratio of filter elements 330 to troughs 320 may be used. The filter elements may be any suitable material, such as screens, fine mesh, or another filter material, that can filter particulate materials from formation fluid received from the wellbore 110.

Turning now to FIGS. 5A-6B, illustrated is an alternative embodiment of a well screen assembly 500 in accordance with the disclosure. The well screen assembly 500 of FIGS. 5A-6B includes many of the same features as the well screen assembly 160 of FIGS. 3A-4B. Accordingly, like reference numerals will be used to reference like features. The well screen assembly 500 additionally includes a plurality of sealing elements 510 positioned radially outside of the flexure mechanisms 220 and connecting adjacent edges of the plurality of fluid collecting elements 210. The sealing elements 510, thus focus any fluid from the subterranean formation 120 surrounding the wellbore 110 into the collection troughs 320 in the plurality of fluid collecting elements 310. Thus, in one embodiment, an only path for the formation fluid received from the wellbore 110 to enter the tubular base pipe 310 is through the collection troughs 320 in the plurality of collecting elements 310.

The sealing elements 510, in the embodiment of FIGS. 5A-6B, are sealing louvers connecting adjacent edges of the plurality of fluid collecting elements 210. For instance, individual sealing louvers might be used to isolate each flexure mechanism 220 from the formation fluid from the wellbore 110. While the sealing louvers are illustrated as connecting adjacent edges of the plurality of collecting elements 210 in FIGS. 5A-6B, certain other embodiments exist wherein each of the sealing louvers couple only to a single fluid collecting element 210, or in another embodiment do not couple to any sealing element, both of which are still capable of isolating each flexure mechanism 220 from the formation fluid from the wellbore 110. Moreover, while the sealing elements 510 have been illustrated as sealing louvers, those skilled in the art appreciate that any feature capable of sealing the flexure mechanisms 220 from the formation fluid received from the wellbore 110 could be used and remain within the scope of the present disclosure.

Figure 5A:
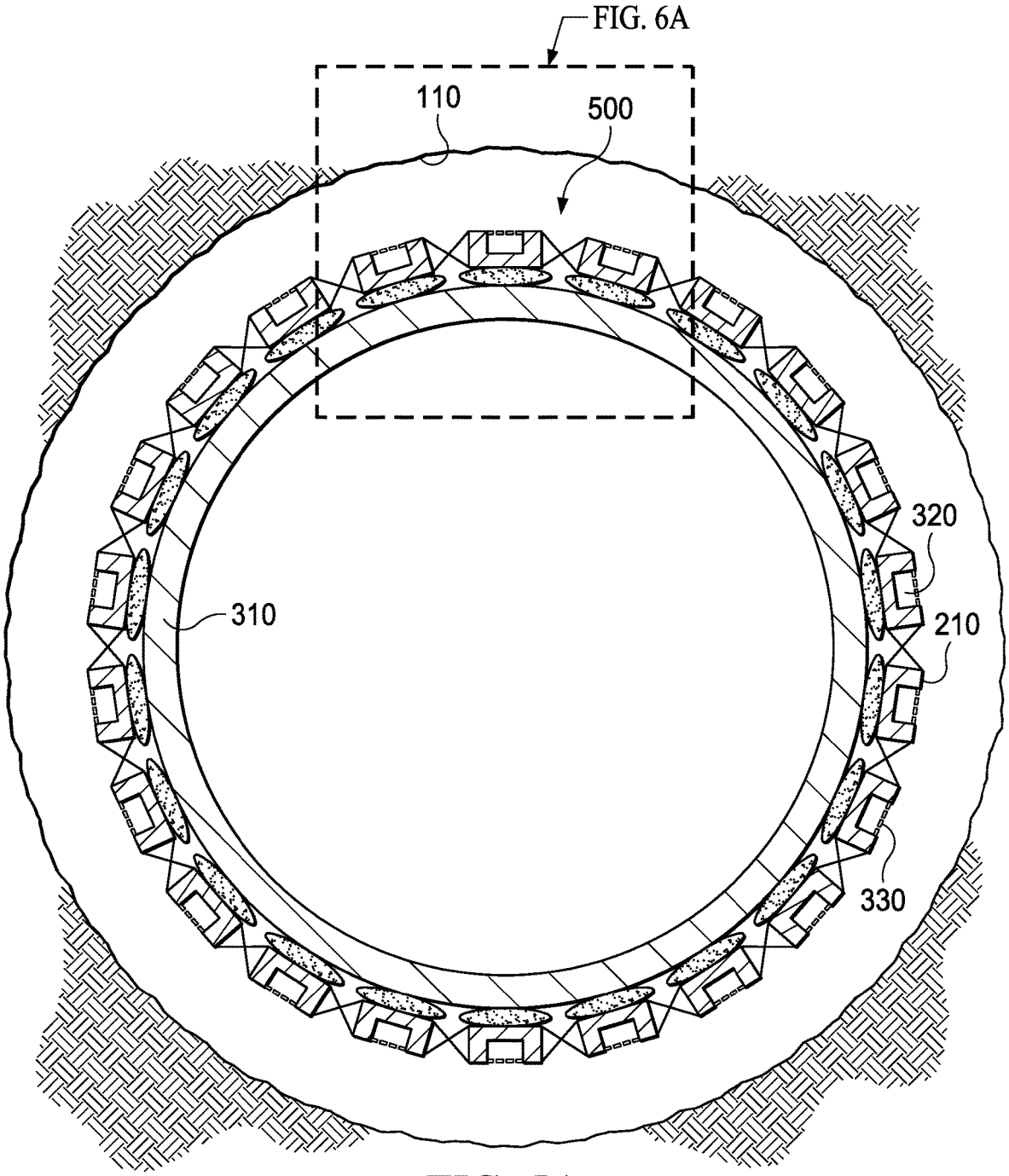
FIGS. 5A-6B illustrate an alternative embodiment of a well screen assembly in accordance with the disclosure.
Figure 5B:
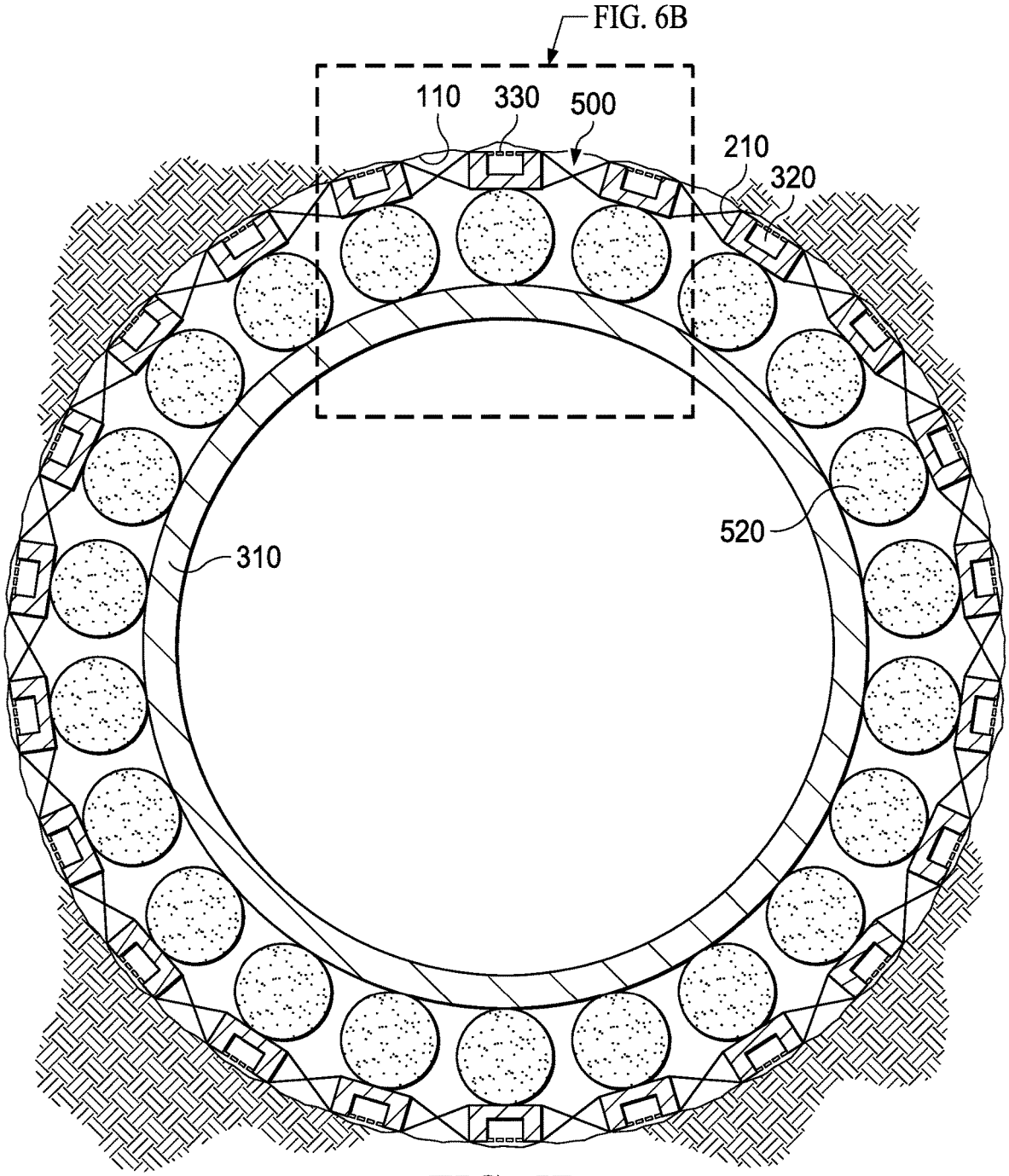
Figure 6A:
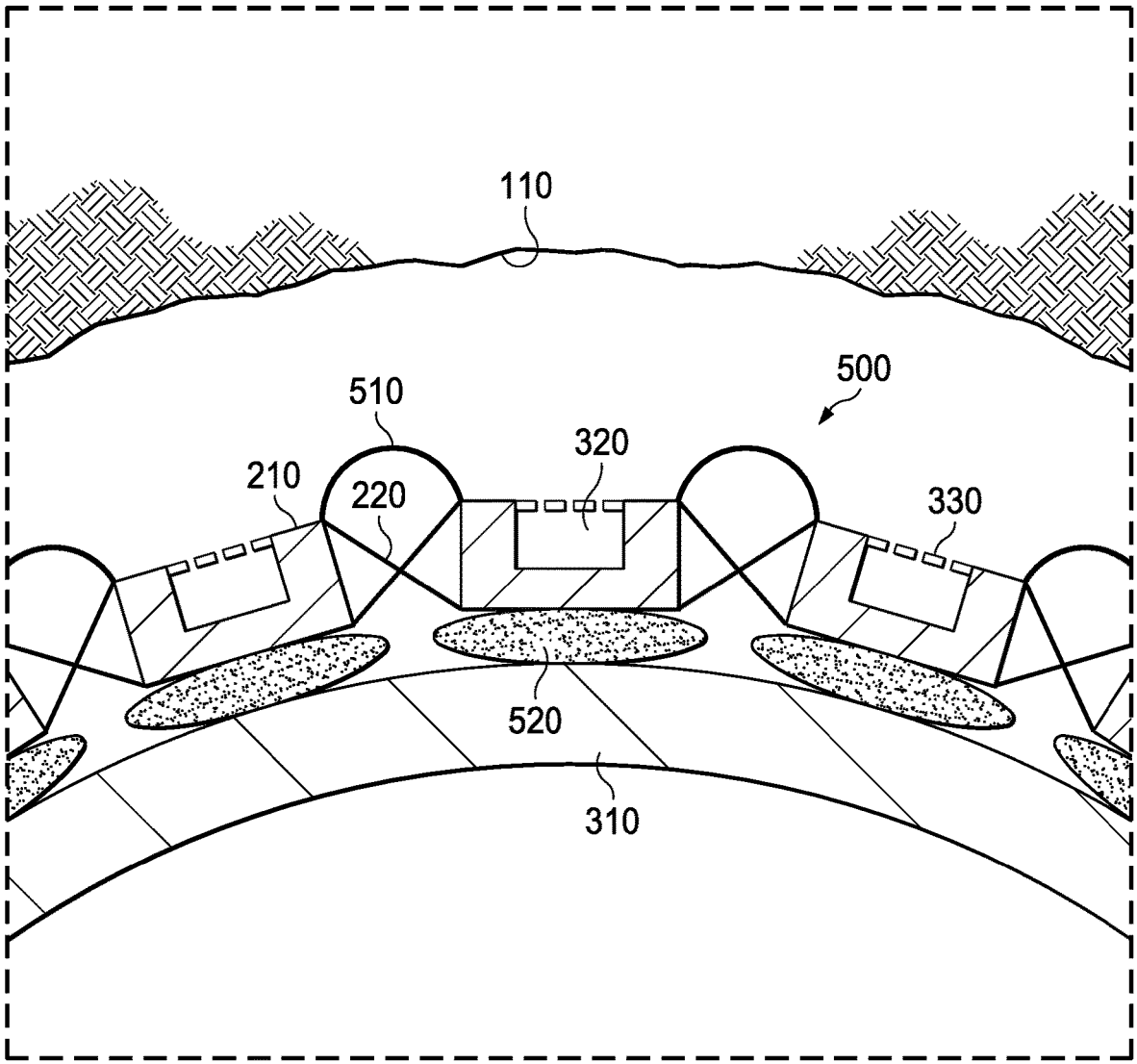
Figure 6B:
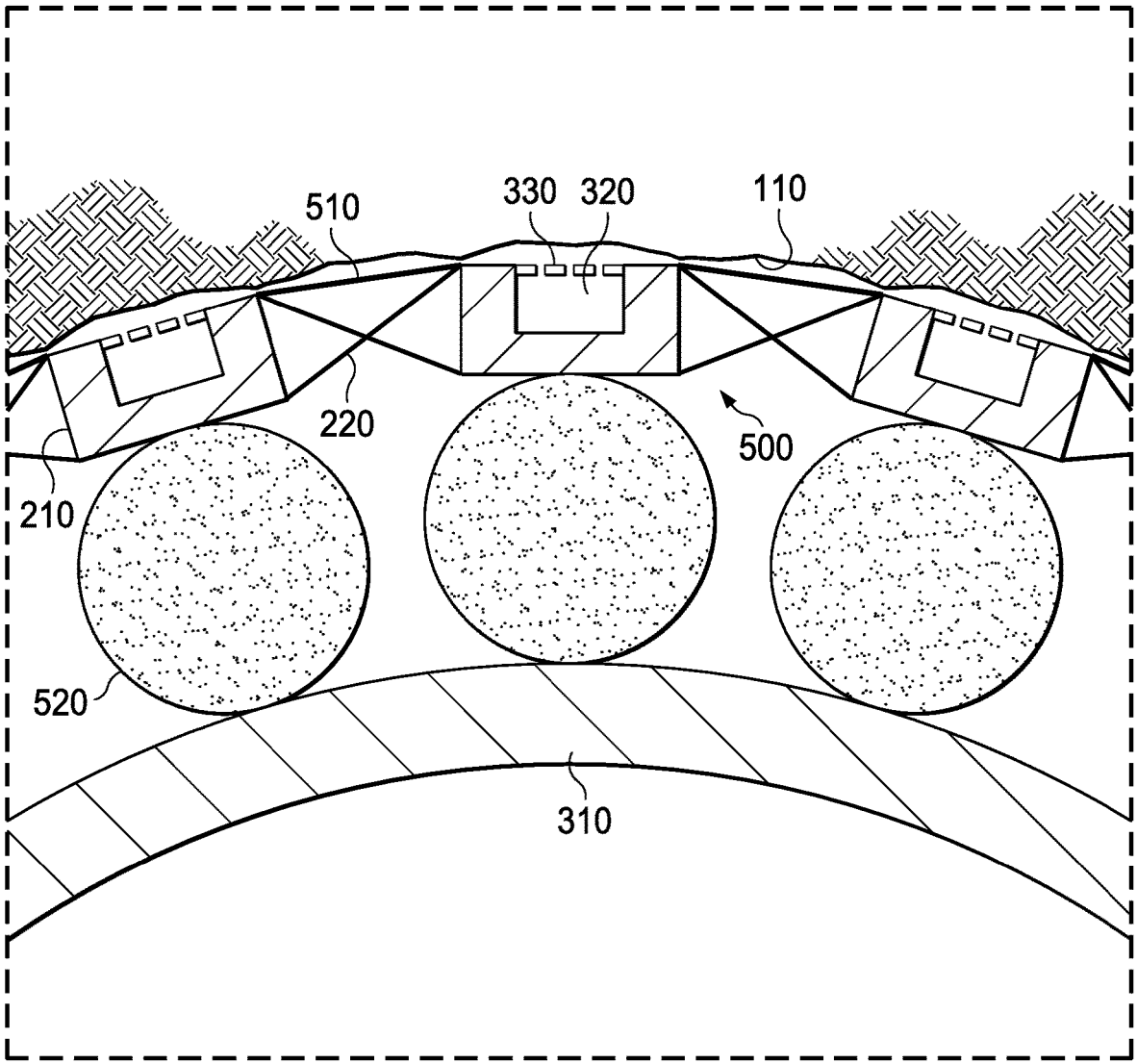

The well screen assembly 500 of the embodiment of FIGS. 5A-6B further includes one or more expansion structures 520 configured to expand the plurality of fluid collecting elements 210 from the compact state (e.g., as shown in FIGS. 5A and 6A) to the radially extended state (e.g., as shown in FIGS. 5B and 6B). The expansions structures 520, in the illustrated embodiment, are positioned between the tubular base pipe 310 and an opposing side of the fluid collecting elements 210 as the troughs 320. In the illustrated embodiment, individual expansion structures 520 are used to expand each of the fluid collecting elements 210. In yet another embodiment, however, a single expansion structure 520 may be used to expand all of the fluid collecting elements 210.

The expansion structures 520 may comprise a variety of different types and materials and remain within the purview of the disclosure. In one embodiment, the expansion structures 520 are one or more swellable elastomer structures. When used, the swellable elastomer structures can expand after contacting an activating fluid, and thus expand the plurality of fluid collecting elements 210 from the compact state (e.g., as shown in FIGS. 5A and 6A) to the radially extended state (e.g., as shown in FIGS. 5B and 6B). Examples of activating fluid include hydrocarbon fluids, gasses, and water.

Various techniques can be used to subject the swellable elastomer structures to an activating fluid. One technique includes configuring the swellable elastomer structures to expand upon contact with activating fluids already present within the wellbore 110 when the screen assembly 500 is installed, or with activating fluids produced by the formation after installation. The swellable elastomer structures may include a mechanism for delaying swell to prevent swelling during installation. Examples of a mechanism for delaying swell include an absorption delaying layer, coating, membrane, or composition. Another technique includes circulating activating fluid through the well after the screen assembly 500 is installed in the well. In other embodiments, the swellable elastomer structures are capable of expansion upon their location in an environment having a temperature or a pressure that is above a pre-selected threshold in addition to or instead of an activating fluid. The thickness of the swellable elastomer structures can be optimized based on the diameter of the screen assembly 500 and the diameter of the wellbore 110 to maximize contact area of the fluid collecting elements 210 with the wellbore 110 upon expansion.

Aspects disclosed herein include:

A. A well screen assembly including a plurality of fluid collecting elements, wherein the fluid collecting elements have collection troughs extending along a length thereof, filter elements positioned over the collection troughs, and flexure mechanisms connecting proximate pairs of the fluid collecting elements, the flexure mechanisms allowing the plurality of fluid collecting elements to radially extend from a compact state to a radially extended state.

B. A method including, with a well screen assembly residing in a well bore, the well screen assembly including, a plurality of fluid collecting elements, wherein the fluid collecting elements have collection troughs extending along a length thereof, filter elements positioned over the collection troughs, flexure mechanisms connecting proximate pairs of the fluid collecting elements, and then radially extending the plurality of fluid collecting elements from a compact state to a radially extended state.

Aspects A and B may have one or more of the following additional elements in combination:

Element 1: wherein the flexure mechanisms interpose the proximate pairs of the fluid collecting elements. Element 2: wherein individual filter elements are positioned over ones of the collection troughs. Element 3: wherein the filter elements are selected from the group consisting of a screen or a mesh. Element 4: further including a plurality of sealing elements positioned radially outside of the flexure mechanisms and connecting adjacent edges of the plurality of fluid collecting elements. Element 5: wherein the sealing elements are sealing louvers. Element 6: wherein the flexure mechanisms taper in size and angle proximate one end of the plurality of collecting elements causing the plurality of collecting elements to taper toward one another proximate the end when in the radially extended state. Element 7: further including a collection mandrel positioned proximate the end of the plurality of collecting elements, wherein the collection mandrel is configured to collect fluid from the collection troughs. Element 8: further including one or more expansion structures positioned proximate an opposing side of the fluid collecting elements as the troughs. Element 9: wherein the one or more expansions structures are one or more swellable elastomer structures positioned between the opposing side of the fluid collecting elements as the troughs and a tubular base pipe. Element 10: wherein individual swellable elastomer structures are positioned proximate the opposing side of the fluid collecting elements as the troughs for each of the fluid collecting elements. Element 11: wherein an only path for fluid from the wellbore to enter the tubular base pipe is through the collection troughs in the plurality of collecting elements.

Those skilled in the art to which this application relates will appreciate that other and further additions, deletions, substitutions and modifications may be made to the described embodiments.

What is claimed is:

1. A well screen assembly, comprising:

a plurality of fluid collecting elements, wherein the fluid collecting elements have collection troughs extending along a length thereof;

filter elements positioned over the collection troughs; and flexure mechanisms connecting proximate pairs of the fluid collecting elements, the flexure mechanisms allowing the plurality of fluid collecting elements to radially extend from a compact state to a radially extended state.

2. The well screen assembly of claim 1, wherein the flexure mechanisms interpose the proximate pairs of the fluid collecting elements.

3. The well screen assembly of claim 1, wherein individual filter elements are positioned over ones of the collection troughs.

4. The well screen assembly of claim 1, wherein the filter elements are selected from the group consisting of a screen or a mesh.

5. The well screen assembly of claim 1, further including a plurality of sealing elements positioned radially outside of the flexure mechanisms and connecting adjacent edges of the plurality of fluid collecting elements.

6. The well screen assembly of claim 5, wherein the sealing elements are sealing louvers.

7. The well screen assembly of claim 1, wherein the flexure mechanisms taper in size and angle proximate one end of the plurality of collecting elements causing the plurality of collecting elements to taper toward one another proximate the end when in the radially extended state.

8. The well screen assembly of claim 7, further including a collection mandrel positioned proximate the end of the plurality of collecting elements, wherein the collection mandrel is configured to collect fluid from the collection troughs.

9. The well screen assembly of claim 1, further including one or more expansion structures positioned proximate an opposing side of the fluid collecting elements as the troughs.

10. The well screen assembly of claim 9, wherein the one or more expansions structures are one or more swellable elastomer structures positioned between the opposing side of the fluid collecting elements as the troughs and a tubular base pipe.

11. The well screen assembly of claim 10, wherein individual swellable elastomer structures are positioned proximate the opposing side of the fluid collecting elements as the troughs for each of the fluid collecting elements.

12. A method, comprising:

with a well screen assembly residing in a well bore, the well screen assembly including;

a plurality of fluid collecting elements, wherein the fluid collecting elements have collection troughs extending along a length thereof;

filter elements positioned over the collection troughs; and flexure mechanisms connecting proximate pairs of the fluid collecting elements; and radially extending the plurality of fluid collecting elements from a compact state to a radially extended state.

13. The method of claim 12, wherein individual filter elements are positioned over ones of the collection troughs.

14. The method of claim 12, further including a plurality of sealing elements positioned radially outside of the flexure mechanisms and connecting adjacent edges of the plurality of fluid collecting elements.

15. The method of claim 12, wherein the flexure mechanisms taper in size and angle proximate one end of the plurality of collecting elements causing the plurality of collecting elements to taper toward one another proximate the end when in the radially extended state.

16. The method of claim 15, further including a collection mandrel positioned proximate the end of the plurality of collecting elements, wherein the collection mandrel is configured to collect fluid from the collection troughs.

17. The method of claim 12, further including one or more expansion structures positioned proximate an inner surface of the fluid collecting elements, and wherein radially extending the plurality of fluid collecting elements including radially extending the plurality of fluid collecting elements using the one or more expansion structures.

18. The method of claim 17, wherein the one or more expansions structures are one or more swellable elastomer structures positioned between the opposing side of the fluid collecting elements as the troughs and a tubular base pipe.

19. The method of claim 18, wherein individual swellable elastomer structures are positioned proximate the opposing side of the fluid collecting elements as the troughs for each of the fluid collecting elements, and further wherein the individual swellable elastomer structures radially extend the plurality of fluid collecting elements.

20. The method of claim 18, wherein an only path for fluid from the wellbore to enter the tubular base pipe is through the collection troughs in the plurality of collecting elements.

* * * * *